US008278540B1

(12) United States Patent
Chen

(10) Patent No.: US 8,278,540 B1
(45) Date of Patent: Oct. 2, 2012

(54) SLIDABLE WIND INSTRUMENT BRACE

(75) Inventor: Yue-Wen Chen, New Taipei (TW)

(73) Assignee: K.H.S. Musical Instrument Co., Ltd., New Taipei (TW)

( * ) Notice: Subject to any disclaimer, the term of this patent is extended or adjusted under 35 U.S.C. 154(b) by 0 days.

(21) Appl. No.: 13/190,978

(22) Filed: Jul. 26, 2011

(51) Int. Cl.
*G10D 7/10* (2006.01)

(52) U.S. Cl. ..... 84/387 R

(58) Field of Classification Search ..... 84/380 R, 84/387 R, 385 A, 387 A, 388–393
See application file for complete search history.

(56) References Cited

U.S. PATENT DOCUMENTS 1,512,023 A * 10/1924 Higgins ..... 84/394
2,036,356 A * 4/1936 Pedler ..... 84/382
2,734,417 A * 2/1956 Hindsley ..... 84/394
4,285,263 A * 8/1981 Larsen ..... 84/382

* cited by examiner

*Primary Examiner* — Kimberly Lockett
(74) *Attorney, Agent, or Firm* — Apex Juris, pllc; Tracy M. Heims

(57) ABSTRACT

A slidable wind instrument brace has an adjusting ring, a first abutting block and a second abutting block. The first abutting block and the second abutting block are respectively mounted on two ends of the adjusting ring. The adjusting ring is rotated to drive the first abutting block and the second abutting block to move close to or away from each other. Therefore, a position of the brace is changeable and a wind instrument with the brace can produce different timbres.

12 Claims, 7 Drawing Sheets

SLIDABLE WIND INSTRUMENT BRACE

BACKGROUND OF THE INVENTION

1. Field of the Invention

The present invention relates to a wind instrument brace, and more particularly to a wind instrument brace slidably mounted between two adjacent tubes for producing different timbres.

2. Description of the Prior Arts

A wind instrument is a musical instrument that contains a tubular resonator. According to methods of producing sound, wind instruments are grouped into two families: brass instruments and woodwind instruments. For the brass instruments, sound is produced by vibration of a player's lips as the player blows into the resonator. The brass instruments include trombones, trumpets, tubas, cornets and the like.

With reference to FIG. 7, a conventional trumpet generally comprises a tubular resonator 50 bent twice into a rounded oblong shape and having two ends, a bell 51, a mouthpiece 52, three piston valves 53, three tuning slides 54 and a brace 55. One of the ends of the resonator 50 is flared to form the bell 51. The mouthpiece 52 is mounted on the other end of the resonator 50. The piston valves 53 are mounted on the resonator 50. The tuning slides 54 are connected respectively to the piston valves 53. The brace 55 is mounted between one of the tuning slides 54 and the resonator 50. A position of the brace 55 affects timbre of the trumpet. That is, the brace 55 mounted near the piston valves 53 results in a bright timbre and the brace 55 mounted away from the piston valves 53 results in a full timbre.

With further reference to FIG. 8, the brace 55 has a column 551 and two connecting segments 552. The connecting segments 552 are respectively formed on two ends of the column 551 and are respectively welded to exterior tube surfaces of the tuning slide 54 and the resonator 50. However, welding the connecting segments 552 to the tuning slide 54 and the resonator 50 makes the position of the brace 55 unchangeable and thereby makes the trumpet only produce one specific timbre.

To overcome the shortcomings, the present invention provides a slidable wind instrument brace to mitigate or obviate the aforementioned problems.

SUMMARY OF THE INVENTION

The main object of the present invention is to provide a slidable wind instrument brace for producing different timbres.

To achieve the foregoing objective, the slidable wind instrument brace in accordance with the present invention comprises an adjusting ring, a first abutting block and a second abutting block. The first abutting block and the second abutting block are respectively mounted on two ends of the adjusting ring. The adjusting ring is rotated to drive the first abutting block and the second abutting block to move close to or away from each other. Therefore, a position of the brace is changeable and a wind instrument with the brace can produce different timbres.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
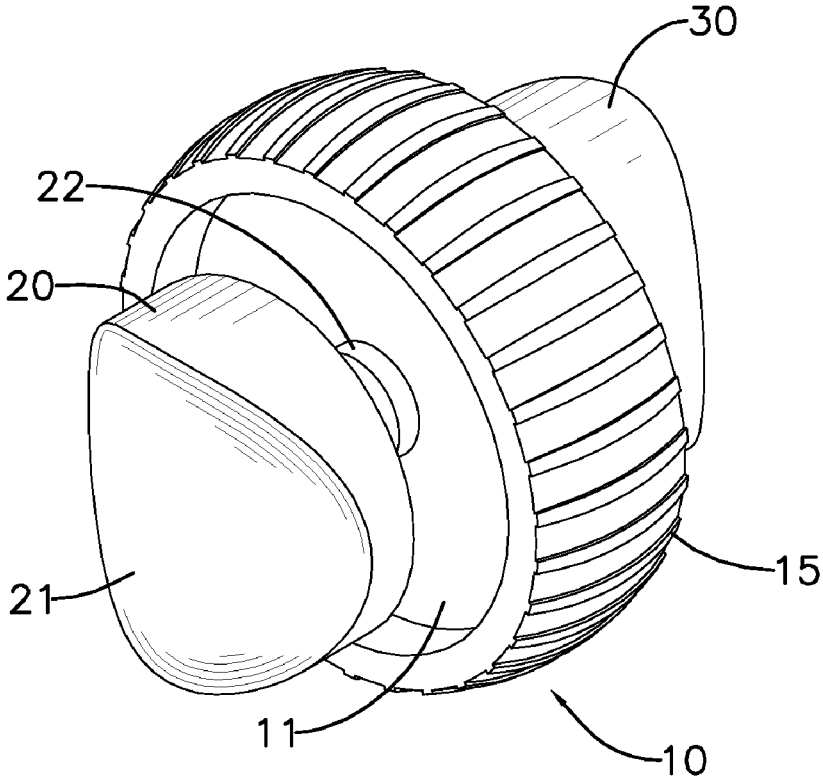
FIG. 1 is a perspective view of a slidable wind instrument brace in accordance with the present invention.
Figure 2:
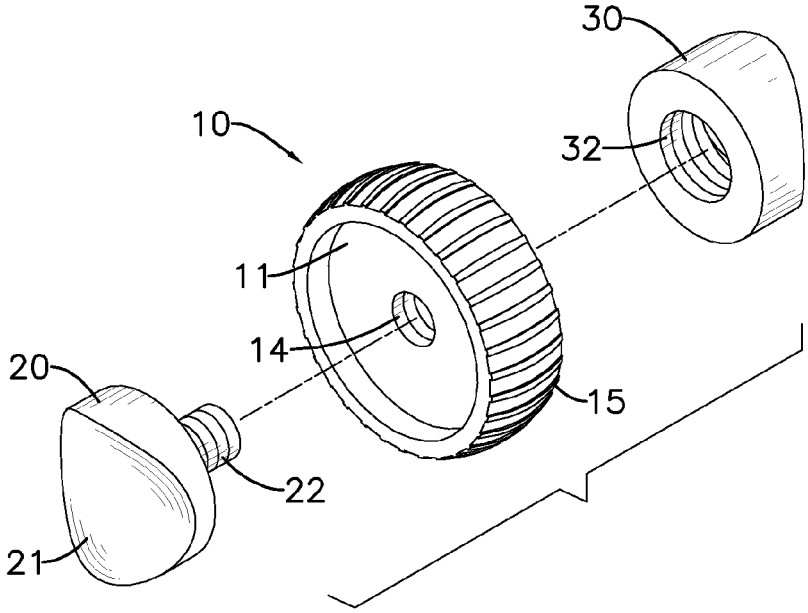
FIGS. 2 and 3 are exploded perspective views of the slidable wind instrument brace in FIG. 1.
Figure 3:
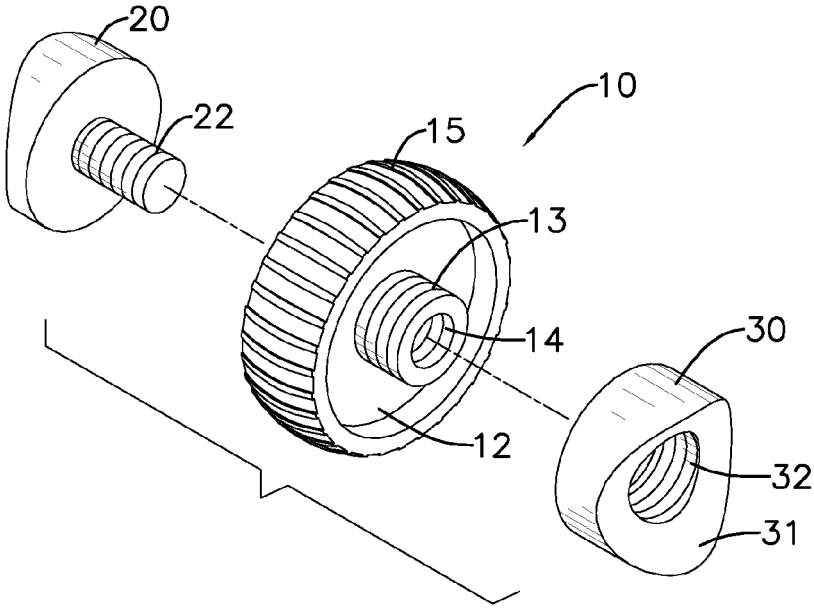
Figure 4:
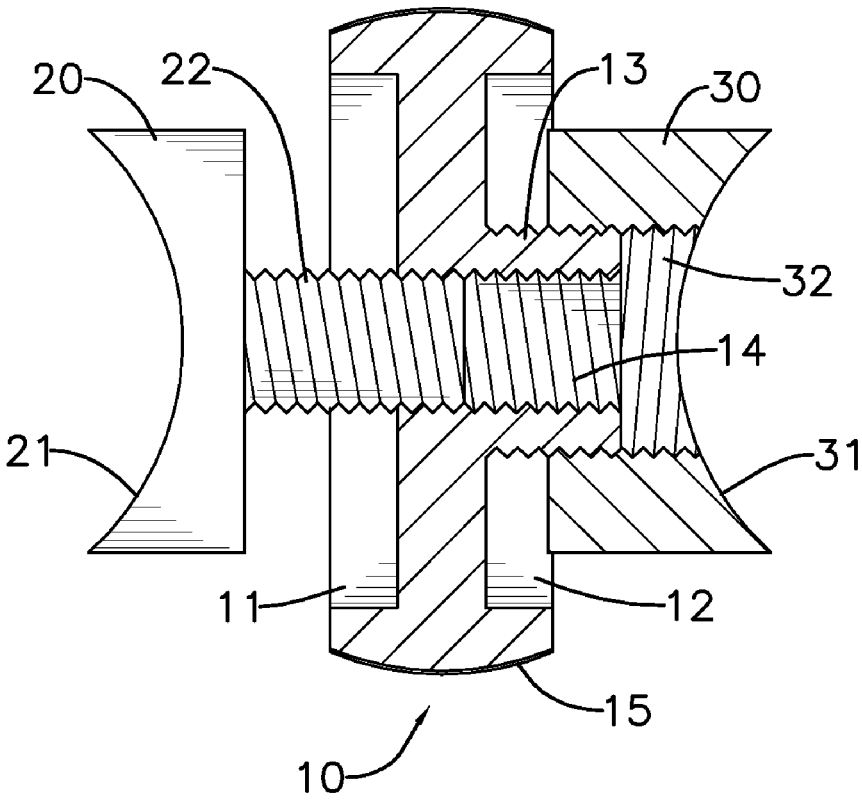
FIG. 4 is a side view in partial section of the slidable wind instrument brace in FIG. 1.

With reference to FIGS. 1 to 4, a slidable wind instrument brace in accordance with the present invention comprises an adjusting ring 10, a first abutting block 20 and a second abutting block 30.

The adjusting ring 10 includes a first end surface, a second end surface, an annular surface, a first recess 11, a second recess 12, a left threaded rod 13, a right threaded hole 14 and multiple skidproof protrusions 15. The first recess 11 is formed in the first end surface of the adjusting ring 10. The second recess 12 is formed in the second end surface of the adjusting ring 10. The left threaded rod 13 is formed on and protrudes longitudinally from a recess surface of the second recess 12. The right threaded hole 14 is formed longitudinally through the left threaded rod 13 and the adjusting ring 10. The skidproof protrusions 15 are formed on and protrude around the annular surface of the adjusting ring 10.

The first abutting block 20 is mounted on the first end surface of the adjusting ring 10 and includes an outer end surface, an inner end surface, an abutting surface 21 and a right threaded bolt 22. The inner end surface of the first abutting block 20 faces the first recess 11 of the adjusting ring 10. The abutting surface 21 is curved and concave and is formed on the outer end surface of the first abutting block 20. The right threaded bolt 22 is formed on and protrudes longitudinally from the inner end surface of the first abutting block 20 and is screwed into the right threaded hole 14 of the adjusting ring 10.

The second abutting block 30 is mounted on the second end surface of the adjusting ring 10 and includes an outer end surface, an inner end surface, an abutting surface 31 and a left threaded hole 32. The inner end surface of the second abutting block 30 faces the second recess 12 of the adjusting ring 10. The abutting surface 31 is curved and concave and is formed on the outer end surface of the second abutting block 30. The left threaded hole 32 is formed longitudinally through the second abutting block 30 and is screwed onto the left threaded rod 13 of the adjusting ring 10.

Figure 5:
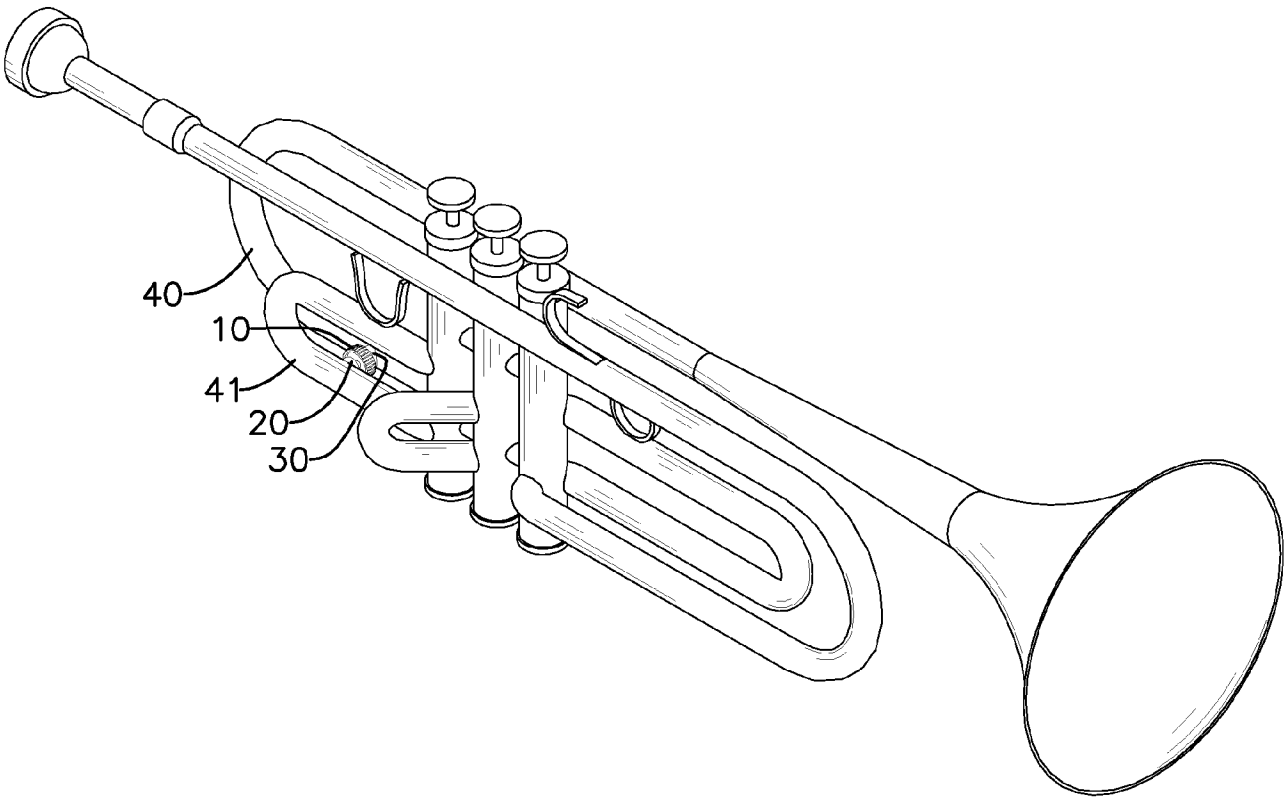
FIG. 5 is a perspective view of a trumpet with the slidable wind instrument brace in FIG. 1.
Figure 6:
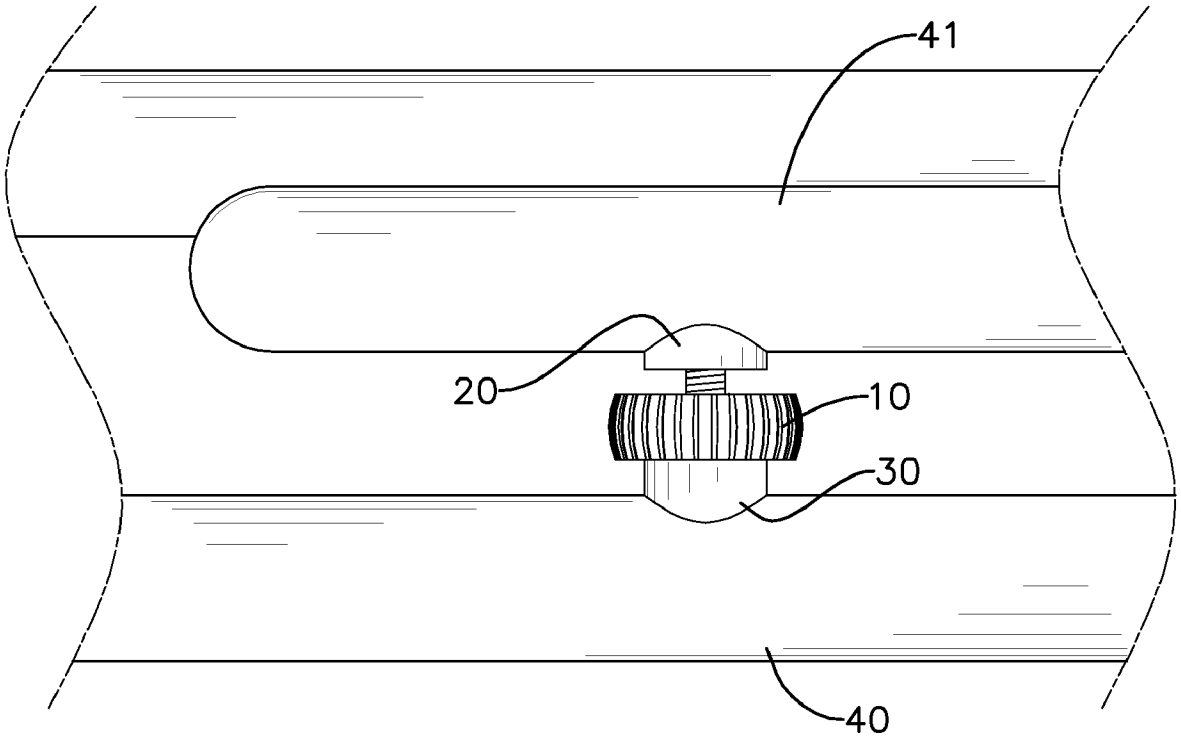
FIG. 6 is a partially enlarged bottom view of the trumpet with the slidable wind instrument brace in FIG. 1.
Figure 7:
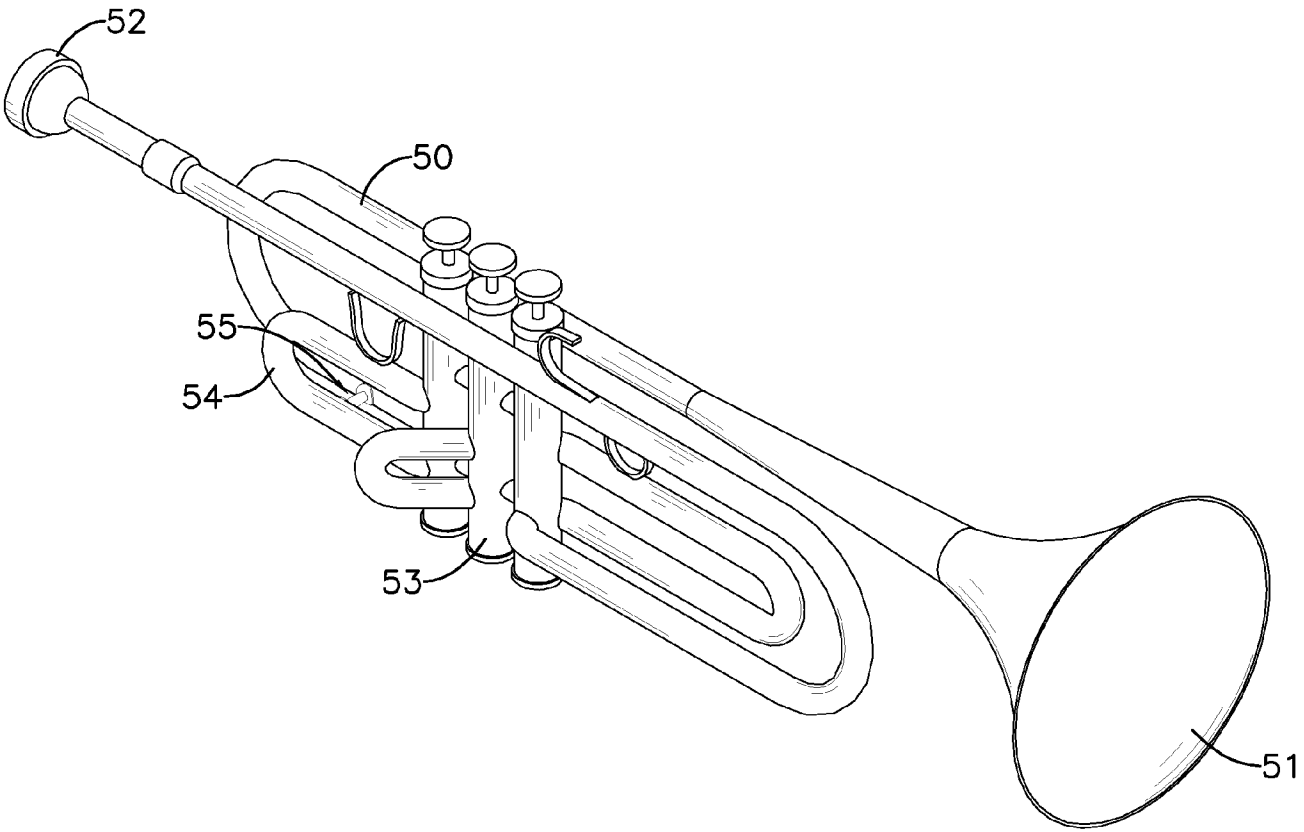
FIG. 7 PRIOR ART
FIG. 7 is a perspective view of a conventional trumpet in accordance with the prior art.
Figure 8:
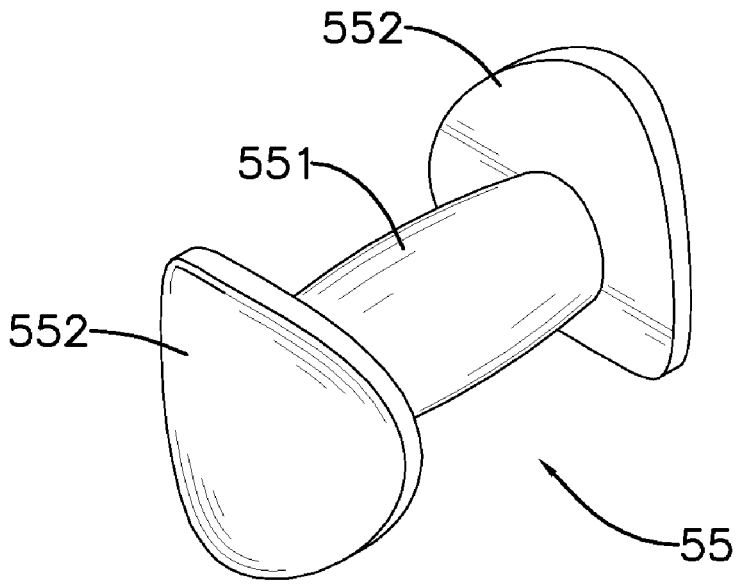
FIG.8 PRIOR ART
FIG. 8 is a perspective view of a brace of the conventional trumpet in FIG. 7.

With reference to FIGS. 5 and 6, the slidable wind instrument brace in accordance with the present invention is mounted between a resonator 40 and a tuning slide 41 of a trumpet. Under this circumstance, the first abutting block 20 and the second abutting block 30 cannot be rotated relative to the adjusting ring 10 but can be slid along the resonator 40 and the tuning slide 41 because the abutting surfaces 21,31 of the first abutting block 20 and the second abutting block 30 respectively correspond to exterior tube surfaces of the resonator 40 and the tuning slide 41. The adjusting ring 10 can be rotated to drive the first abutting block 20 and the second abutting block 30 to move away from each other and to drive the abutting surfaces 21,31 of the first abutting block 20 and the second abutting block 30 to tightly abut the exterior tube surfaces of the resonator 40 and the tuning slide 41. Thus, the brace can be positioned securely between the resonator 40 and the tuning slide 41.

When users want to change timbres of the trumpet, the adjusting ring 10 is rotated in reverse to drive the first abutting block 20 and the second abutting block 30 to move close to each other so that the brace can be slid along the resonator 40 and the tuning slide 41 to adjust to a suitable position. After the position of the brace has been adjusted, the adjusting ring 10 is re-rotated to make the brace positioned securely between the resonator 40 and the tuning slide 41. Therefore, users can easily change timbres of the trumpet by adjusting positions of the brace for different needs.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A slidable wind instrument brace comprising:

an adjusting ring including a first end surface and a second end surface;

a first abutting block mounted on the first end surface of the adjusting ring; and a second abutting block mounted on the second end surface of the adjusting ring, the adjusting ring rotated to drive the first abutting block and the second abutting block to move close to or away from each other.

2. The slidable wind instrument brace as claimed in claim 1, wherein the adjusting ring includes a left threaded rod formed on and protruding longitudinally from the second end surface; and a right threaded hole formed longitudinally through the left threaded rod and the adjusting ring;

the first abutting block includes an inner end surface facing the first end surface of the adjusting ring; and a right threaded bolt formed on and protruding from the inner end surface of the first abutting block and screwed into the right threaded hole of the adjusting ring; and the second abutting block includes an inner end surface facing the second end surface of the adjusting ring; and a left threaded hole formed through the second abutting block and screwed onto the left threaded rod of the adjusting ring.

3. The slidable wind instrument brace as claimed in claim 2, wherein the first abutting block includes an outer end surface; and an abutting surface being curved and concave and formed on the outer end surface of the first abutting block; and the second abutting block includes an outer end surface; and an abutting surface being curved and concave and formed on the outer end surface of the second abutting block.

4. The slidable wind instrument brace as claimed in claim 1, wherein the adjusting ring includes multiple skidproof protrusions formed on and protruding around an annular surface of the adjusting ring.

5. The slidable wind instrument brace as claimed in claim 2, wherein the adjusting ring includes multiple skidproof protrusions formed on and protruding around an annular surface of the adjusting ring.

6. The slidable wind instrument brace as claimed in claim 3, wherein the adjusting ring includes multiple skidproof protrusions formed on and protruding around an annular surface of the adjusting ring.

7. The slidable wind instrument brace as claimed in claim 1, wherein the adjusting ring includes a first recess formed in the first end surface of the adjusting ring; and a second recess formed in the second end surface of the adjusting ring.

8. The slidable wind instrument brace as claimed in claim 2, wherein the adjusting ring includes a first recess formed in the first end surface of the adjusting ring; and a second recess formed in the second end surface of the adjusting ring.

9. The slidable wind instrument brace as claimed in claim 3, wherein the adjusting ring includes a first recess formed in the first end surface of the adjusting ring; and a second recess formed in the second end surface of the adjusting ring.

10. The slidable wind instrument brace as claimed in claim 4, wherein the adjusting ring includes a first recess formed in the first end surface of the adjusting ring; and a second recess formed in the second end surface of the adjusting ring.

11. The slidable wind instrument brace as claimed in claim 5, wherein the adjusting ring includes a first recess formed in the first end surface of the adjusting ring; and a second recess formed in the second end surface of the adjusting ring.

12. The slidable wind instrument brace as claimed in claim 6, wherein the adjusting ring includes a first recess formed in the first end surface of the adjusting ring; and a second recess formed in the second end surface of the adjusting ring.

* * * * *